US008646343B2

(12) United States Patent
Kimura et al.

(10) Patent No.: US 8,646,343 B2
(45) Date of Patent: Feb. 11, 2014

(54) PIPETTE DEVICE

(75) Inventors: Shoichi Kimura, Hyogo (JP); Hozumi Nakajima, Saitama (JP); Kazuho Takayanagi, Hyogo (JP); Makoto Takehara, Hyogo (JP)

(73) Assignee: Fukae Kasei Co., Ltd., Kobe (JP)

( * ) Notice: Subject to any disclaimer, the term of this patent is extended or adjusted under 35 U.S.C. 154(b) by 485 days.

(21) Appl. No.: 12/960,620

(22) Filed: Dec. 6, 2010

(65) Prior Publication Data

US 2011/0132110 A1 Jun. 9, 2011

(30) Foreign Application Priority Data

Dec. 7, 2009 (JP) ..... 2009-277750

(51) Int. Cl.
*B01L 3/02* (2006.01)

(52) U.S. Cl.
CPC ..... *B01L 3/0224* (2013.01); *B01L 2300/026* (2013.01)
USPC ..... 73/864.18

(58) Field of Classification Search
CPC ..... B01L 3/0224; B01L 2300/026
USPC ..... 73/864.18
See application file for complete search history.

(56) References Cited

U.S. PATENT DOCUMENTS

| | | | | |
|---|---|---|---|---|
| 3,013,435 | A | 12/1961 | Rodrigues, Jr. | |
| 4,086,062 | A * | 4/1978 | Hach | B01L 3/0224 |
| 4,096,750 | A | 6/1978 | Sturm | |
| 4,098,125 | A * | 7/1978 | Lee | 73/864.18 X |
| 5,143,006 | A | 9/1992 | Jimenez | |
| 5,413,006 | A | 5/1995 | D'Autry | |
| 5,531,131 | A * | 7/1996 | Sabloewski | 73/864.18 |
| 5,650,124 | A | 7/1997 | Gilson | |
| 5,747,709 | A * | 5/1998 | Oshikubo | 73/864.18 |
| 6,253,628 | B1 * | 7/2001 | Steele et al. | B01L 3/0224 |
| 6,254,832 | B1 * | 7/2001 | Rainin et al. | 73/864.18 X |
| 6,428,750 | B1 | 8/2002 | Rainin et al. | |
| 6,455,006 | B1 * | 9/2002 | Mukai | B01L 3/0224 |
| 6,715,369 | B2 | 4/2004 | Baba et al. | |
| 7,175,813 | B2 * | 2/2007 | Petrek et al. | 73/864.18 X |
| 7,434,484 | B2 * | 10/2008 | Belgardt | B01L 2300/026 |
| 7,585,468 | B2 * | 9/2009 | Jaghuber | B01L 3/0224 |
| 8,096,198 | B2 * | 1/2012 | Molitor | 73/864.18 |
| 2007/0014696 | A1 * | 1/2007 | Molitor | B01L 3/0224 |
| 2010/0011889 | A1 * | 1/2010 | Lemmo | B01L 3/0224 |

FOREIGN PATENT DOCUMENTS

| | | | | |
|---|---|---|---|---|
| EP | 0153058 | A2 | 8/1985 | |
| EP | 801983 | A1 * | 10/1997 | B01L 3/02 |
| EP | 1197264 | A2 * | 4/2002 | B01L 3/02 |

(Continued)

OTHER PUBLICATIONS

European Search Report for EP Application No. 10194008.8-2113, Mailed Mar. 23, 2011.

*Primary Examiner* — Thomas P Noland
(74) *Attorney, Agent, or Firm* — Smith Patent Office

(57) ABSTRACT

There is provided a pipette device capable of adjusting a collection amount in a short time. A pipette device 1 adjusting a volume of a cylinder portion "a" by the axial-direction movement of a plunger 3 caused by the rotation of a push rod 5 includes a speed increasing mechanism 35 provided between a pipette main body 2 and the push rod 5 and increasing a speed of input rotation to transmit the input rotation with the increased speed to the push rod 5.

5 Claims, 8 Drawing Sheets

(56) References Cited

FOREIGN PATENT DOCUMENTS

| | | | | | |
|---|---|---|---|---|---|
| JP | 06-210188 | A | | 8/1994 | |
| JP | 2002-113373 | A | | 4/2002 | |
| JP | 2004-509731 | A | | 4/2004 | |
| JP | 2005-180636 | A | | 7/2005 | |
| JP | 2007-516836 | A | | 6/2007 | |
| JP | 2010155223 | A | * | 7/2010 | ..... B01L 3/02 |
| WO | WO 9213638 | A1 | * | 8/1992 | ..... B01L 3/02 |
| WO | WO 9810265 | A1 | * | 3/1998 | ..... B01L 3/02 |
| WO | WO 2004020096 | A1 | * | 3/2004 | ..... B01L 3/02 |
| WO | 2005065360 | A2 | | 7/2005 | |
| WO | WO 2005093787 | A1 | * | 10/2005 | ..... B01L 3/02 |

* cited by examiner

PIPETTE DEVICE

BACKGROUND OF THE INVENTION

1. Field of the Invention

The present invention relates to a pipette device for collecting a predetermined amount of a sample (liquid) used for inspection, analysis, experiments, and the like.

2. Description of the Related Art

A pipette device of this type includes a collection amount adjusting mechanism capable of finely adjusting a collection amount of a liquid. For example, Japanese Patent Application Laid-open No. Hei 6-210188 discloses the following. In a cylinder portion of a pipette main body, a plunger changing a cylinder volume is reciprocatably disposed, a push rod reciprocating the plunger is inserted in the pipette main body to be rotatable and movable in an axial direction, and a nut member engaged with the push rod is unrotatably supported in the pipette main body. The axial-direction movement of the push rod is caused by the rotation of an adjustment knob fixed to the push rod, whereby a stroke amount of the plunger is adjusted.

SUMMARY OF THE INVENTION

In the above-described conventional pipette device, since a stroke amount per rotation of the adjustment knob is small, the collection amount cannot be adjusted to a desired amount unless the push rod is rotated a considerably large number of times, which involves a problem that the adjustment takes a lot of time. In particular, when the collection amount frequently changes, the adjustment takes a lot of trouble and workability lowers. Therefore, there is a demand for improvement in this point.

The present invention has been developed in consideration of the above conventional circumstances, and has an object to provide a pipette device capable of adjusting a collection amount in a short time.

The present invention is a pipette device which includes: a pipette main body having a cylinder portion; a plunger disposed in an inserted state in the cylinder portion to be movable in an axial direction and changing a cylinder volume; a push rod which is inserted in the pipette main body to be rotatable and movable in the axial direction and to which the plunger is connected; and a nut supported in the pipette main body to be unrotatable and movable in the axial direction and converting the rotation of the push rod to the axial-direction movement of the push rod, and which adjusts the cylinder volume by the axial-direction movement of the plunger caused by the rotation of the push rod, the pipette device including a speed increasing mechanism provided between the pipette main body and the push rod and increasing a speed of input rotation to transmit the input rotation with the increased speed to the push rod.

According to the present invention, since the speed increasing mechanism increasing the speed of the input rotation to transmit the input rotation with the increased speed to the push rod is provided, it is possible to adjust a collection amount in a short time, which can improve workability.

In a preferable embodiment of the present invention, the speed increasing mechanism is of a planetary gear type that includes: a sun gear provided to be coaxial with the push rod; a planetary gear rotating on an own axis while rotating around an outer periphery of the sun gear; a carrier rotatably supported by the pipette main body and supporting the planetary gear so as to allow the planetary gear to rotate; and an outer ring which is unrotatably supported by the pipette main body and on whose inner peripheral surface an internal gear engaged with the planetary gear is formed, and the speed increasing mechanism increases a speed of rotation input to the carrier to transmit the rotation with the increased speed to the push rod.

According to the above preferable embodiment, since the speed increasing mechanism is the planetary gear mechanism, it is possible to obtain a large speed increase ratio with a compact structure, and the speed increasing mechanism can be disposed between the pipette main body and the push rod without any size increase of the pipette main body.

In another preferable embodiment of the present invention, the speed increasing mechanism outputs rotation inputted to the push rod, from the push rod without any change.

According to the above another preferable embodiment, the speed increasing mechanism is structured to output the rotation inputted to the push rod, from the push rod without any change. Therefore, in adjusting a collection amount, rough adjustment can be made in a short time by the speed increasing mechanism, and by subsequently rotating the push rod, fine adjustment can be made, which can enhance accuracy in adjusting the collection amount.

In still another preferable embodiment of the present invention, the carrier has a holding portion in a bottomed cylindrical shape supporting the planetary gear so as to allow the planetary gear to rotate; and a bearing plate fitted in an opening of the holding portion, the planetary gear is disposed in an opening portion formed in the holding portion, and shaft portions at both ends of the planetary gear are rotatably supported by a bottom wall of the holding portion and the bearing plate.

According to the above still another embodiment, the carrier houses the planetary gear in the opening portion formed in its holding portion in the bottomed cylindrical shape and supports the shaft portions at the both ends of the planetary gear by the bottom wall of its holding portion and its bearing plate so as to allow the shaft portions to rotate. Therefore, the planetary gear part can be downsized, which makes it possible to dispose the speed increasing mechanism without any size increase of the pipette main body.

In yet another preferable embodiment of the present invention, the carrier has a projecting portion integrally formed with the holding portion and projecting out in the axial direction from the pipette main body, and an input member is fitted to the projecting portion.

According to the above yet another embodiment, since the input member is fitted to the projecting portion integrally formed with the holding portion of the carrier and projecting out in the axial direction from the pipette main body, it is possible to easily rotate the carrier by rotating the input member.

According to yet another preferable embodiment of the present invention, the carrier is rotatably supported by the outer ring.

According to the above yet another preferable embodiment, since the carrier is rotatably supported by the outer ring fixed to the pipette main body, it is possible to realize the structure in which the carrier is rotatably supported by the pipette main body, without any complication of the structure and without any increase in the number of components.

DETAILED DESCRIPTION OF THE PREFERRED EMBODIMENT

Figure 1:
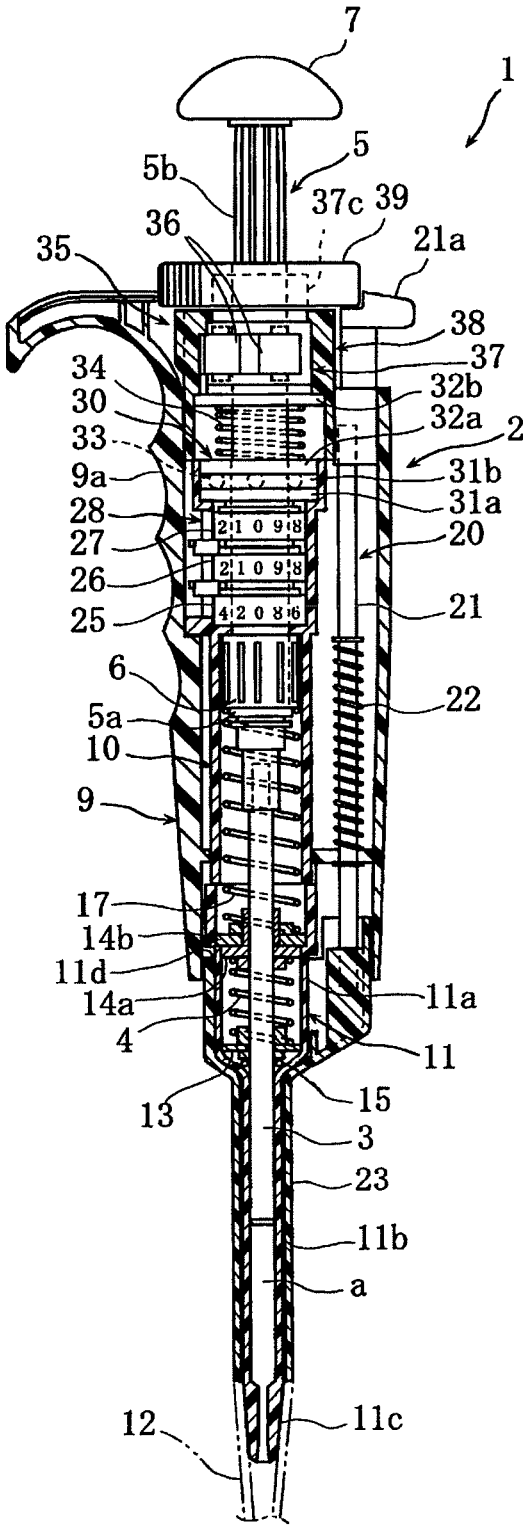
FIG. 1 is a side sectional view of a pipette device according to an embodiment 1 of the present invention.
Figure 2:
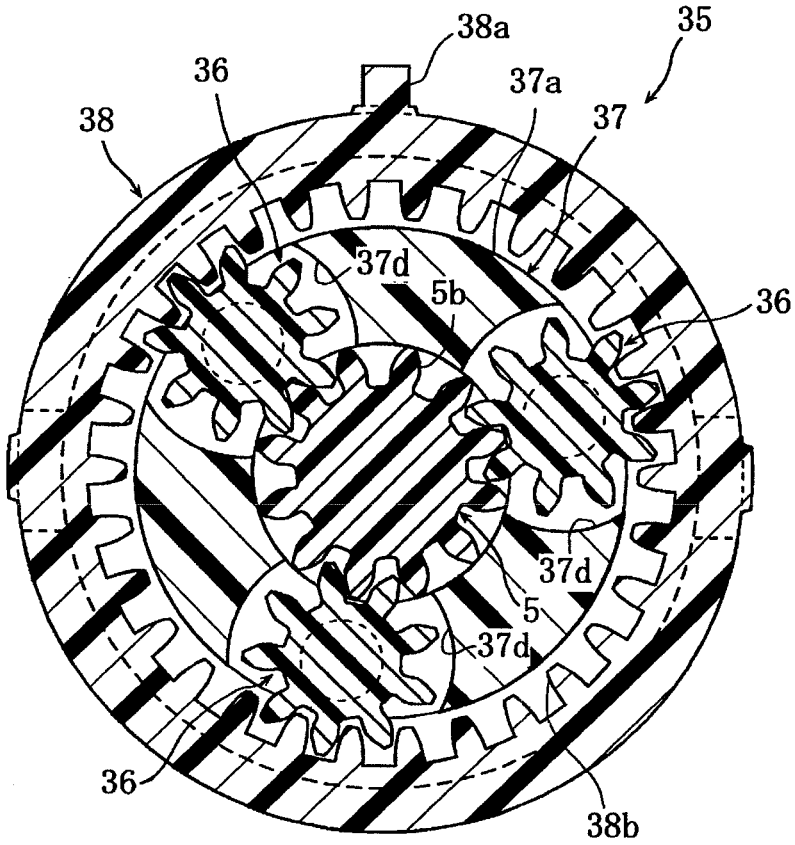
FIG. 2 is a horizontal sectional view (sectional view taken along II-II line in FIG. 3) of a speed increasing mechanism of the pipette device.
Figure 3:
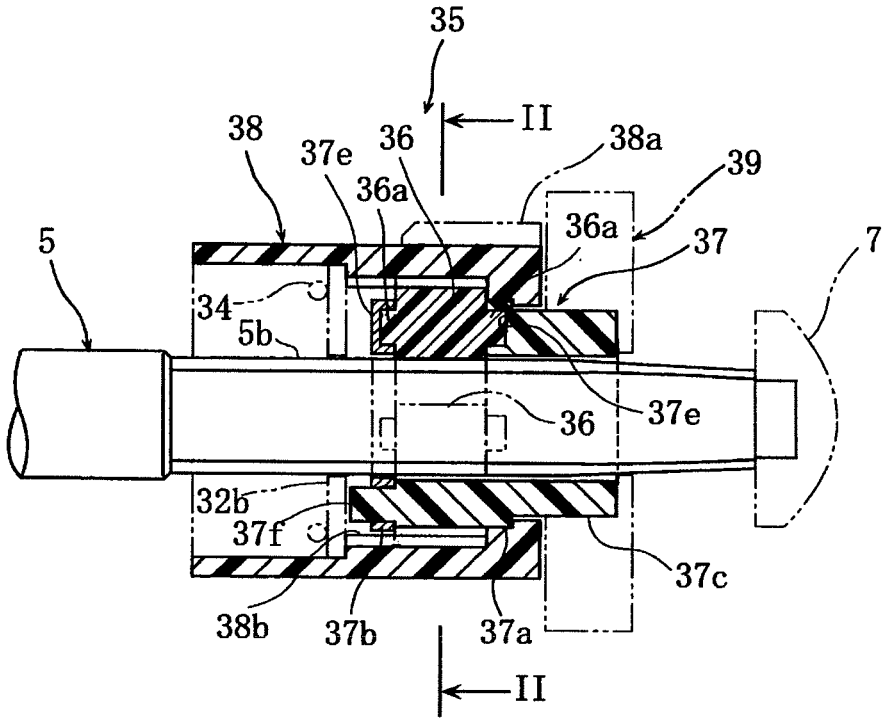
FIG. 3 is a side sectional view (sectional view taken along line in FIG. 4A of the speed increasing mechanism.
Figure 4A:
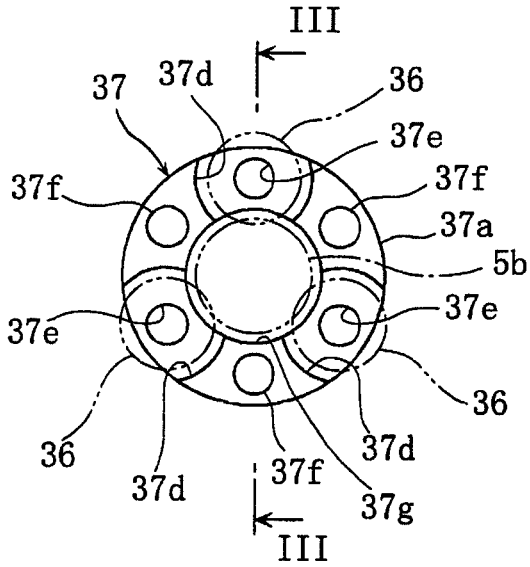
FIG. 4A is a front view of the speed increasing mechanism.
Figure 4B:
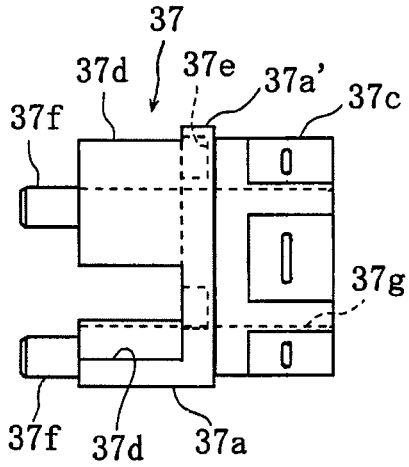
FIG. 4B is a side view of the speed increasing mechanism.
Figure 4C:
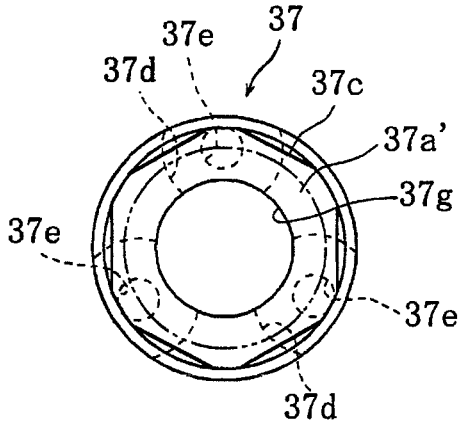
FIG. 4C is a rear view of the speed increasing mechanism.
Figure 5A:
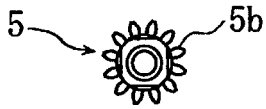
FIG. 5A is a front view of a push rod in which a sun gear of the speed increasing mechanism is formed.
Figure 5B:
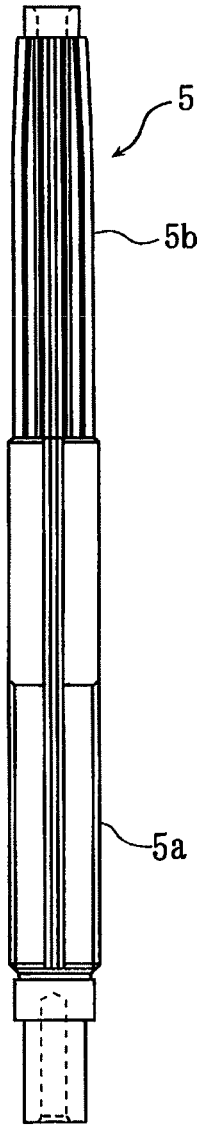
FIG. 5B is a side view of the push rod.
Figure 6A:
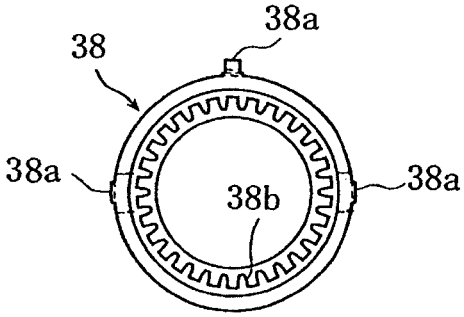
FIG. 6A is a front view of an outer ring of the speed increasing mechanism respectively.
Figure 6B:
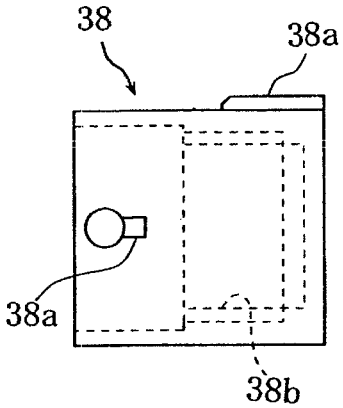
FIG. 6B is a side view of the outer ring.
Figure 7A:
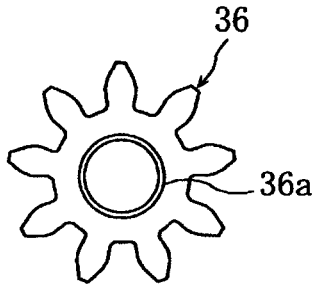
FIG. 7A is a front view of a planetary gear of the speed increasing mechanism respectively.
Figure 7B:
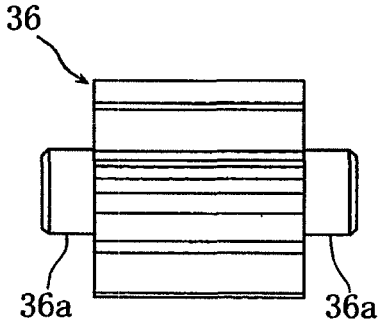
FIG. 7B is a side view of the planetary gear.
Figure 8:
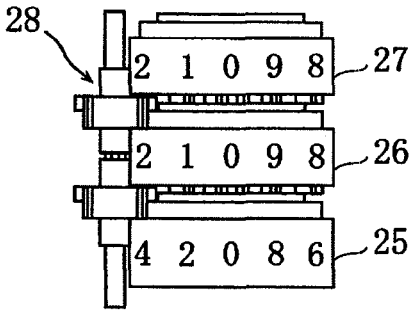
FIG. 8 is a side view of calibrated dials of the pipette device.
Figure 9:
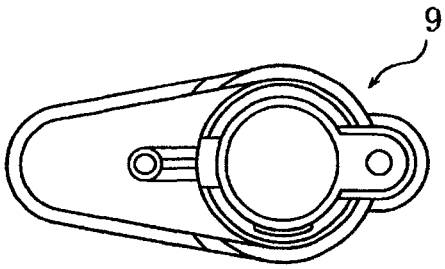
FIG. 9 is a plane view of an outer housing of the pipette device.
Figure 10:
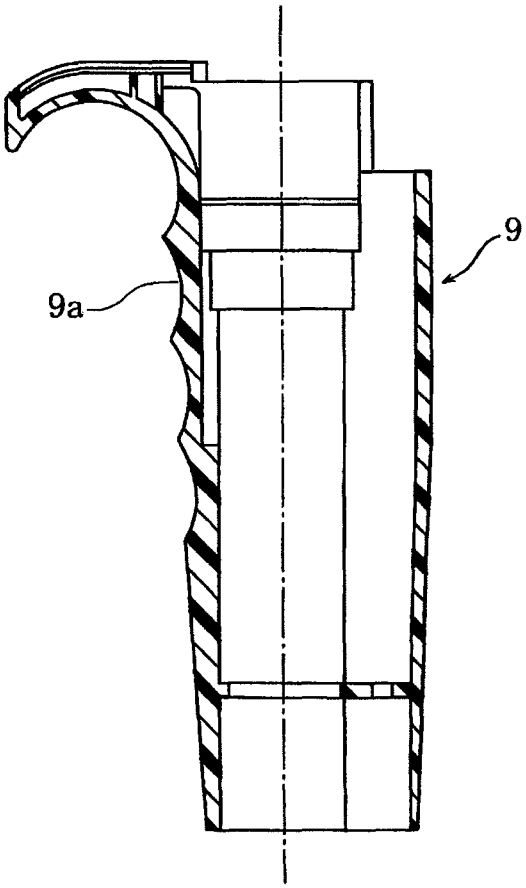
FIG. 10 is a side sectional view of the outer housing.

Hereinafter, an embodiment of the present invention will be described based on the attached drawings.

Embodiment 1

FIG. 1 to FIG. 10 are views for explaining a pipette device according to an embodiment 1 of the present invention.

In the drawings, 1 denotes the pipette device for collecting a predetermined amount of a sample (liquid) used for inspection, analysis, experiments, and the like.

The pipette device 1 includes: a pipette main body 2 having a cylinder portion "a"; a plunger 3 disposed in the cylinder portion "a" to be movable in an axial direction and changing a cylinder volume of the cylinder portion "a"; a push rod 5 inserted in the pipette main body 2 to be rotatable and movable in the axial direction and moving the plunger 3 in the axial direction; and a nut 6 unrotatably supported in the pipette main body 2 and converting the rotation of the push rod 5 to the axial-direction movement of the push rod 5. Note that the cylinder volume means an axial-direction movable distance (stroke) of the plunger 3.

The pipette main body 2 has: an outer housing 9 in a cylindrical shape having a grip portion 9*a*; an inner housing disposed in the outer housing 9; and a nozzle cone 11 extending downward from the inner housing 10.

The nozzle cone 11 has: a lager-diameter portion 11*a*; a small-diameter portion 11*b* continuously formed from the large-diameter portion 11*a* and forming the cylinder portion "a"; and a nozzle portion 11*c* formed in a tapered shape at a tip portion of the small-diameter portion 11*b*. A pipette tip 12 is attachably/detachably fitted to the nozzle portion 11*c*.

The plunger 3 is disposed so as to extend from the nozzle cone 11 to the inside of a lower portion of the inner housing 10, and the push rod 5 is disposed so that most part thereof is located in the inner housing 10. An upper end portion of the plunger 3 is fittingly inserted in a lower end portion of the push rod 5. Further, an upper portion of the push rod 5 protrudes upward from the pipette main body 2, and a push button 7 is fixed to an upper end portion of the push rod 5.

A spring 4 is disposed between a spring bearing washer 13 and a spring bearing washer 14*a*, the former washer 13 being fixedly disposed at a boundary portion between the large-diameter portion 11*a* and the small-diameter portion 11*b* of the nozzle cone 11, and the latter washer 14*a* being disposed in an upper portion of the nozzle cone 11. Further, at the boundary portion, an O-ring 15 is disposed to airtightly seal a gap between the small-diameter portion 11*b* and the plunger 3. The O-ring 15 is pressed by the spring bearing washer 13 due to a biasing force of the spring 4, which ensures the sealing.

The nut 6 is screwed to a screw portion 5*a* formed in the lower end portion of the push rod 5 so as to be relatively rotatable and is spline-connected to an inner surface of the inner housing 10 so as to be movable in the axial direction and so as to be unrotatable. Furthermore, a spring bearing washer 14*b* is disposed on a stepped portion 11*d* formed in the upper portion of the nozzle cone 11, and between the spring bearing washer 14*b* and the nut 6 screwed to the lower portion of the push rod 5, a spring member 17 is disposed. The spring bearing washer 14*b* prevents the spring bearing washer 14*a* from moving upward.

The pipette device 1 includes a pipette detaching mechanism 20 detaching the pipette tip 12 that has been used, from the nozzle cone 11.

The detaching mechanism 20 has: an eject cone 23 fitted around an outer peripheral portion of the nozzle cone 11; an eject rod 21 coupled to the eject cone 23; and a return spring 22 biasing the eject rod 21 in a return direction (upward in FIG. 1). An upper end portion of the eject cone 23 is inserted in a lower end portion of the outer housing 9. Further, an eject button 21*a* is attached to an upper end portion of the eject rod 21, and a lower end of the eject cone 23 faces and abuts on the pipette tip 12.

When the eject button 21*a* is pressed down by a finger, the eject rod 21 moves down the eject cone 23, so that the used pipette tip 12 is pressed down to fall from the nozzle cone 11. When the finger is detached from the eject button 21*a*, the eject rod 21 is returned to the original position by the return spring 22, followed by the returning of the eject cone 23.

First to third calibrated dials 25 to 27 are fitted to the push rod 5. The first calibrated dial 25 is connected to the push rod 5 so as to rotate with the push rod 5 and so as to be relatively movable in the axial direction, and the second and third calibrated dials 26, 27 are fitted to the push rod 5 so as to be relatively rotatable. Further, the first to third calibrated dials 25 to 27 are coupled to one another by a gear shaft 28.

When the push rod 5 rotates, the first calibrated dial 25 rotates by one graduation and its indication increases, and when the indication of the first calibrated dial 25 increases by 10 graduations, the indication of the second calibrated dial 26 increases by one graduation, and further, when the indication of the second calibrated dial 26 increases by 10 graduations, the indication of the third calibrated dial 27 increases by one graduation. In this manner, the graduations of the calibrated dials 25 to 27 change according to the number of rotations of the push rod 5, and it is confirmed that the cylinder volume has been adjusted so that a collection amount becomes an amount corresponding to the graduations.

It should be noted that the number of rotations of the push rod 5 and the change in the graduations of the calibrated dials 25 to 27 are not limited to the above example. For example, when the indication of the first calibrated dial 25 increases by five or two graduations, the indication of the second calibrated dial 26 may increase by one graduation.

In the inner housing 10, a restricting mechanism 30 is disposed to restrict the improper rotation of the push rod 5. The restricting mechanism 30 has: a fixed plate 31*a* unrotatably fixed to the inner housing 10; a movable plate 31*b* fitted to the push rod 5 so as to rotate with the push rod 5; a plurality of balls 33 held by the movable plate 31*b*; a spring washer 32*a* which and the fixed plate 31*a* sandwich the balls 33; and a biasing spring 34 pressing and biasing the spring washer 32*a* toward the fixed plate 31*a*. A concave portion in which the balls 33 are caught is formed in the fixed plate 31*a*.

Between the inner housing 10 and the push rod 5, a speed increasing mechanism 35 of a planetary gear type is disposed to transmit input rotation to the push rod 5, after increasing its speed or without any change.

The speed increasing mechanism 35 has: a sun gear 5*b* formed in an upper portion of the push rod 5 integrally and coaxially with the push rod 5; three planetary gears 36 rotating on own axes while rotating around an outer periphery of the sun gear 5*b*; a carrier 37 supporting the planetary gears 36 so as to allow the planetary gears 36 to rotate; and an outer ring 38 which has an internal gear 38*b* engaged with the planetary gears 36 and is unrotatably supported by the outer housing 9 of the pipette main body 2.

The outer ring 38 is in a cylindrical shape, and on its outer peripheral surface, a fitting portion 38*a* fitted to the outer housing 9 is formed, and in an axial-direction upper half portion of its inner peripheral surface, the internal gear 38*b* is formed. Further, in a lower half portion of the inner peripheral surface, the spring washer 32*b* is disposed, and the spring 34 is in pressure contact with the spring washer 32*b*.

The carrier 37 has: a holding portion 37*a* in a cylindrical shape having a bottom wall 37*a*'; and a bearing plate 37*b* fitted to an axial-direction lower end portion of the holding portion 37*a*. A through hole 37*g* through which the push rod 5 passes is formed in the bottom wall 37*a*'. Further, the bearing plate 37*b* is fixed owing to press-fitting of boss portions 37*f* integrally formed with the holding portion 37*a*. Further, in an axial-direction upper end portion of the holding portion 37*a*, a hexagonal projecting portion 37*c* to which a speed increasing dial 39 is fitted is integrally formed so as to project from the pipette main body 2.

Further, in the holding portion 37*a*, opening portions 37*d* housing the planetary gears 36 are formed in a slit shape. The planetary gears 36 are disposed in the opening portions 37*d*.

In the bottom wall 37*a*' of the holding portion 37*a* and the bearing plate 37*b*, shaft holes 37*e* supporting shaft portions 36*a* of the planetary gears 36 so as to allow the shaft portions 36*a* to rotate are formed. The planetary gears 36 are disposed in the opening portions 37*d* to be engaged with the internal gear 38*b* and the sun gear 5*b*.

In the speed increasing mechanism 35 of this embodiment, the number of teeth of each of the gears, an input member, and an output member are set so that one rotation of the speed increasing dial 39 causes about 3.5 rotations of the push rod 5. Concretely, for example, the number of teeth of the sun gear 5*b* is set to 12, the number of teeth of each of the planetary gears 36 is set to 9, and the number of teeth of the internal gear 38*b* is set to 30, and the speed increasing dial 39, that is, the carrier 37 serves as the input member and the push rod 5 serves as the output member.

It goes without saying that the speed increase ratio is not limited to the above example.

To collect the sample by the pipette device 1 of this embodiment, the speed increasing dial 39 is rotated by a finger until the graduations of the first to third calibrated dials 25 to 27 indicate a value substantially corresponding to a necessary collection amount, and subsequently the push rod 5 is rotated for fine adjustment. In this case, as described above, the rotation of the speed increasing dial 39 is transmitted to the push rod 5 after its speed is tripled, and when the push rod 5 is rotated, the push rod 5 rotates as it is to move the plunger 3 in the axial direction, so that a stroke amount of the plunger 3 and as a result, a volume of the cylinder portion "a" is set.

The pipette tip 12 is fitted to the nozzle portion 11*c* of the nozzle cone 11, and the push button 7 is pressed down by the finger to move the plunger 3 to a lower end position in a cylinder volume reducing direction. In this state, the pipette tip 12 is immersed in the sample and the finger is detached from the push button 7. Then, the plunger 3 moves up in a volume increasing direction by the biasing force of the spring 17, a pressure in the pipette tip 12 becomes negative, and the indicated amount of the sample is collected. In order to inject the collected sample into a device for inspection, analysis, or the like, it is only necessary to push the push button 7 again, and consequently, the plunger 3 moves down and the sample is jetted from the pipette tip 12. Thereafter, the eject button 21*a* is pressed down to eject the used pipette tip 12.

According to this embodiment, since there is provided the speed increasing mechanism 35 transmitting the input rotation input to the speed increasing dial 39 to the push rod 5 after increasing its speed, it is possible to adjust the collection amount of the sample in a short time. This makes it possible to improve collection workability even when the setting of the collection amount is frequently changed, which enables a quick collection work.

In this embodiment, the speed increasing mechanism 35 is the planetary gear mechanism including: the sun gear 5*b* integrally formed with the push rod 5; the three planetary gears 36 rotating on their own axes while rotating around the outer periphery of the sun gear 5*b*; the carrier 37 supporting the planetary gears 36 so as to allow the planetary gears 36 to rotate; and the internal gear 38*b* engaged with the planetary gears 36. This structure makes it possible to obtain a large speed increase ratio with a compact structure.

Further, since the speed increasing mechanism 35 is the mechanism of the planetary gear type, it is possible to obtain a large speed increase ratio with a compact structure, which makes it possible to dispose the speed increasing mechanism 35 between the pipette main body 2 and the push rod 5 without any size increase of the pipette main body 2.

Further, the speed increasing mechanism 35 is structured to output the rotation inputted to the push rod 5, from the push rod 5 without any change. Therefore, in adjusting the collection amount, the rough adjustment can be made in a short time by the speed increasing mechanism 35, and by subsequently rotating the push rod 5, the fine adjustment can be made, which can enhance accuracy of the collection amount adjustment.

Further, the carrier 37 houses the planetary gears 36 in the opening portions 37*d* formed in the holding portion 37*a* in the bottomed cylindrical shape and supports the shaft portions 36*a* at the both ends of the planetary gears 36 by the bottom wall 37*a*' of the holding portion 37*a* and the bearing plate 37*b* so as to allow the shaft portions 36*a* to rotate. Therefore, it is possible to downsize a part corresponding to the planetary gears 36, which makes it possible to dispose the speed increasing mechanism 35 without any size increase of the pipette main body 2.

Further, the speed increasing dial (input member) 39 is fitted to the projecting portion 37*c* integrally formed with the holding portion 37*a* of the carrier 37 and projecting out in the axial-direction from the pipette main body 2. This makes it possible to easily rotate the carrier 37 by rotating the speed increasing dial 39.

Furthermore, since the carrier 37 is rotatably supported by the outer ring 38 fixed to the pipette main body 2, it is possible to realize the structure in which the carrier 37 is rotatably supported by the pipette main body 2, without causing any complication of the structure or any increase in the number of components.

The above embodiment describes the case where the speed increasing mechanism 35 is of the planetary gear type, but it should be noted that the speed increasing mechanism of the present invention is not limited to this. For example, the speed increasing mechanism can be formed by the combination of spur gears or by a harmonic gear.

The invention may be embodied in other specific forms without departing from the spirit or essential characteristics thereof.

The present embodiments are therefore to be considered in all respects as illustrative and no restrictive, the scope of the invention being indicated by the appended claims rather than by the foregoing description, and all changes which come within the meaning and range of equivalency of the claims are therefore intended to be embraced therein.

What is claimed is:

1. A pipette device which includes: a pipette main body having a cylinder portion; a plunger disposed in an inserted state in the cylinder portion to be movable in an axial direction and changing a cylinder volume; a push rod which is inserted in the pipette main body to be rotatable and movable in the axial direction and to which the plunger is connected; and a nut supported in the pipette main body to be unrotatable and movable in the axial direction and converting the rotation of the push rod to the axial-direction movement of the push rod, and which adjusts the cylinder volume by the axial-direction movement of the plunger caused by the rotation of the push rod, the pipette device comprising a speed increasing mechanism provided between the pipette main body and the push rod, the speed increasing mechanism being of a planetary gear type that includes: a sun gear, planetary gears, a carrier and an outer ring and the speed increasing mechanism increasing a speed of rotation input to transmit the rotation with the increased speed to the push rod, the carrier has a holding portion in a bottomed cylindrical shape supporting the planetary gears so as to allow the planetary gears to rotate; a projecting portion integrally formed with the holding portion and projecting out in the axial direction from the pipette main body, and an input member is fitted to the projecting portion.

2. The pipette device according to claim 1, wherein said speed increasing mechanism is of the planetary gear type that includes: the sun gear provided to be coaxial with the push rod; at least one of the planetary gears rotating on an own axis while rotating around an outer periphery of the sun gear; and the outer ring which is non-rotatably supported by the pipette main body and on whose inner peripheral surface an internal gear engaged with the planetary gears are formed.

3. The pipette device according to claim 2, wherein said speed increasing mechanism outputs rotation inputted to the push rod, from the push rod without any change.

4. The pipette device according to claim 2, further comprising a bearing plate fitted in an opening of the holding portion, one of the planetary gears is disposed in an opening portion formed in the holding portion, and shaft portions at both ends of the planetary gear are rotatably supported by a bottom wall of the holding portion and the bearing plate.

5. The pipette device according to claim 2, wherein the carrier is rotatably supported by the outer ring.

* * * * *